US009338867B2

(12) United States Patent
Toshida et al.

(10) Patent No.: US 9,338,867 B2
(45) Date of Patent: May 10, 2016

(54) IONIZER AND CONTROL METHOD THEREOF

(71) Applicant: SMC Corporation, Chiyoda-ku (JP)

(72) Inventors: Takayuki Toshida, Moriya (JP); Tomokazu Hariya, Noda (JP); Naoto Sasada, Taito-ku (JP)

(73) Assignee: SMC CORPORATION, Chiyoda-ku (JP)

( * ) Notice: Subject to any disclaimer, the term of this patent is extended or adjusted under 35 U.S.C. 154(b) by 54 days.

(21) Appl. No.: 14/510,221

(22) Filed: Oct. 9, 2014

(65) Prior Publication Data

US 2015/0124368 A1 May 7, 2015

(30) Foreign Application Priority Data

Nov. 1, 2013 (JP) ..... 2013-228563

(51) Int. Cl.
*H05F 3/06* (2006.01)
*H01T 19/04* (2006.01)

(52) U.S. Cl.
CPC . *H05F 3/06* (2013.01); *H01T 19/04* (2013.01)

(58) Field of Classification Search
CPC ..... H01T 19/04; H01T 23/00; H05F 3/06
USPC ..... 361/230
See application file for complete search history.

(56) References Cited

U.S. PATENT DOCUMENTS 5,930,105 A * 7/1999 Pitel ..... H01T 23/00 361/212
7,973,292 B2 * 7/2011 Tsumori ..... H01T 23/00 250/423 F (Continued)

FOREIGN PATENT DOCUMENTS

JP 10-255954 A 9/1998
JP 2005-108742 A 4/2005

(Continued)

OTHER PUBLICATIONS

Office Action issued on Oct. 27,2015 in Japanese Patent Application No. 2013-228563 with English translation.

*Primary Examiner* — Stephen W Jackson
*Assistant Examiner* — Christopher Clark
(74) *Attorney, Agent, or Firm* — Oblon, McClelland, Maier & Neustadt, L.L.P.

(57) ABSTRACT

An ionizer includes a polarity output unit that can selectively output, to a discharge unit, one of a first polarity pattern where the polarity output unit applies a positive direct-current voltage to a first group of discharge needles and applies a negative direct-current voltage to a second group of discharge needles and a second polarity pattern where the polarity output unit applies a negative direct-current voltage to the first group of discharge needles and applies a positive direct-current voltage to the second group of discharge needles and a polarity control unit configured to control the first and second polarity patterns. The polarity control unit includes a current detection unit configured to detect respective direct currents passing through the first group of discharge needles and the second group of discharge needles. When the difference between the current values of the first group of discharge needles and the second group of discharge needles detected by the current detection unit becomes greater than a predetermined value, the polarity control unit switches between the first and second polarity patterns.

3 Claims, 3 Drawing Sheets

(56) References Cited

U.S. PATENT DOCUMENTS

2007/0279829 A1* 12/2007 Gefter ..... H01T 23/00 361/213
2008/0151465 A1* 6/2008 Fujita ..... H01T 23/00 361/220
2009/0207548 A1* 8/2009 Seto ..... H01T 23/00 361/213
2009/0219663 A1* 9/2009 Sato ..... H01T 23/00 361/220
2010/0044581 A1* 2/2010 Fujita ..... H01T 23/00 250/424
2011/0115362 A1* 5/2011 Sekoguchi ..... B03C 3/383 313/230
2011/0134580 A1* 6/2011 Suzuki ..... H01T 23/00 361/212
2012/0006996 A1* 1/2012 Nishino ..... H01T 23/00 250/395
2012/0081831 A1* 4/2012 Ishii ..... B03C 3/368 361/231
2012/0257318 A1* 10/2012 Fujita ..... H01T 23/00 361/212
2013/0258543 A1* 10/2013 Suzuki ..... H01T 23/00 361/231
2013/0271164 A1* 10/2013 Savich ..... G01R 27/2605 324/679
2013/0342028 A1* 12/2013 Hermann ..... C02F 1/46104 307/109
2014/0071579 A1* 3/2014 Hariya ..... H01T 23/00 361/230

FOREIGN PATENT DOCUMENTS

JP 2006-92888 A 4/2006
JP 2008-153132 7/2008
JP 2008-288072 11/2008

* cited by examiner

IONIZER AND CONTROL METHOD THEREOF

TECHNICAL FIELD

The present invention relates to an ionizer and control method thereof for electrically neutralizing charged work or the like using cations and anions generated by applying high voltages to discharge needles.

To prevent electrostatic failures such as electrostatic damage or electrostatic adsorption, there have been used electrostatic eliminators that generate cations and anions using corona discharges which occur by applying high voltages to discharge needles, that is, ionizers. Ionizers are broadly classified into a type in which direct-current voltages are applied to discharge needles (hereafter referred to as the DC type) and a type in which alternating-current voltages are applied to discharge needles (hereafter referred to as the AC type).

DC-type ionizers include discharge needles for discharging cations and discharge needles for discharging anions and, by applying positive and negative direct-current voltages to the groups of discharge needles, respectively, simultaneously discharge cations and anions from the positive and negative discharge needles. For this reason, compared to AC-type ionizers, which apply alternating-current voltages to discharge needles, DC-type ionizers are advantageous in that they can suppress recombination of cations and anions and thus can discharge away more cations and anions and eliminate static electricity faster.

In such a corona-discharge ionizer, however, the discharge needles degrade due to corrosion, wear, or the like caused by its long-time use. In particular, the positive discharge needles are known to degrade more easily than the negative discharge needles. This causes a problem that the balance between cations and anions discharged from the positive and negative discharge needles is lost with time, resulting in a reduction in static elimination performance.

To prevent such temporal ionic imbalance, Patent Literatures 1 and 2 propose electrostatic eliminators that simultaneously discharge ions having one polarity from a first group of discharge needles and ions having the other polarity from a second group of discharge needles and invert the polarity of ions discharged from each group each time a predetermined time passes.

However, the electrostatic eliminators disclosed in Patent Literatures 1 and 2 invert the polarity of each group of discharge needles in a short cycle (predetermined time) of 0.05 s or less. Accordingly, they do not necessarily provide an optimum solution when it is necessary to prevent temporal ionic imbalance while sufficiently utilizing the advantages of the DC type as described above.

CITATION LIST

Patent Literature

PTL 1: Japanese Unexamined Patent Application Publication No. 2008-153132

PTL 2: Japanese Unexamined Patent Application Publication No. 2008-288072

SUMMARY OF INVENTION

Technical Problem

An object to the present invention is to provide an ionizer and control method thereof which can prevent temporal ionic imbalance by equalizing the degrees of degradation of the discharge needles due to corrosion, wear, or the like caused by its long-time use while utilizing the advantages of the DC type as described above, as well as can improve the life of the entire discharge needles.

Solution to Problem

To solve the above problem, an ionizer according to the present invention includes: a discharge unit including 2n discharge needles configured to discharge cations or anions in accordance with the polarity of an applied direct-current voltage, n being a natural number, wherein the discharge needles are grouped into a first group of n discharge needles and a second group of n discharge needles; a polarity output unit that can selectively output, to the discharge unit, one of a first polarity pattern where the polarity output unit applies a positive direct-current voltage to the first group of discharge needles and applies a negative direct-current voltage to the second group of discharge needles and a second polarity pattern where the polarity output unit applies a negative direct-current voltage to the first group of discharge needles and applies a positive direct-current voltage to the second group of direct-current voltage; a polarity control unit configured to control the polarity pattern outputted by the polarity output unit; and a power supply connected to the polarity output unit and configured to supply power to the polarity output unit. The polarity control unit includes a current detection unit configured to detect values of respective currents passing through the first group of discharge needles and the second group of discharge needles. When a value obtained by subtracting, from the current value of one group to which a negative direct-current voltage has been applied, the current value of the other group to which a positive direct-current voltage has been applied becomes greater than a predetermined value, the polarity control unit outputs, to the polarity output unit, an command signal for changing the polarity pattern outputted by the polarity output unit from one polarity pattern which has been outputted thus far to the other polarity.

In the ionizer, the polarity output unit may include: a first positive circuit configured to apply a positive direct-current voltage to the first group of discharge needles; a first negative circuit configured to apply a negative direct-current voltage to the first group of discharge needles; a second positive circuit configured to apply a positive direct-current voltage to the second group of discharge needles; a second negative circuit configured to apply a negative direct-current voltage to the second group of discharge needles; a first switch configured to electrically connect or disconnect the power supply and the first positive circuit; a second switch configured to electrically connect or disconnect the power supply and the first negative circuit; a third switch configured to electrically connect or disconnect the power supply and the second positive circuit; and a fourth switch configured to electrically connect or disconnect the power supply and the second negative circuit. The polarity output unit may output the first polarity pattern by turning on the first switch and the fourth switch and turning off the second switch and the third switch on the basis of a command signal from the polarity control unit or outputs the second polarity pattern by turning off the first switch and the fourth switch and turning on the second switch and the third switch on the basis of a command signal from the polarity control unit.

To solve the above problem, the present invention provides a method for controlling an ionizer, the ionizer including a discharge unit including 2n discharge needles configured to discharge cations or anions in accordance with the polarity of an applied direct-current voltage, n being a natural number, wherein the discharge needles are grouped into a first group of n discharge needles and a second group of n discharge needles; a polarity output unit that can selectively output, to the discharge unit, one of a first polarity pattern where the polarity output unit applies a positive direct-current voltage to the first group of discharge needles and applies a negative direct-current voltage to the second group of discharge needles and a second polarity pattern where the polarity output unit applies a negative direct-current voltage to the first group of discharge needles and applies a positive direct-current voltage to the second group of direct-current voltage; and a power supply connected to the polarity output unit and configured to supply power to the polarity output unit. The method includes: detecting values of respective currents passing through the first group of discharge needles and the second group of discharge needles; and when a value obtained by subtracting, from the current value of one group to which a negative direct-current voltage has been applied, the current value of the other group to which a positive direct-current voltage has been applied becomes greater than a predetermined value, changing a polarity pattern outputted by the polarity output unit from one polarity pattern which has been outputted far thus to the other polarity pattern.

Advantageous Effects of Invention

According to the present invention, the ionizer includes the polarity output unit that can selectively output, to the discharge unit, one of the first polarity pattern, where the polarity output unit applies a positive direct-current voltage to the first group of discharge needles and applies a negative direct-current voltage to the second group of discharge needles and the second polarity pattern, where the polarity output unit applies a negative direct-current voltage to the first group of discharge needles and applies a positive direct-current voltage to the second group of direct-current voltage. The values of the currents passing through the first group of discharge needles and the second group of discharge needles are detected. When a value obtained by subtracting, from the current value of one group to which a negative direct-current voltage has been applied, the current value of the other group to which a positive direct-current voltage has been applied becomes greater than a predetermined value, the polarity pattern outputted by the polarity output unit is changed from one polarity pattern which has been outputted thus far to the other polarity.

When the group of discharge needles which are discharging cations degrade to a greater degree and thus the difference in degradation degree between this group and the group of discharge needles which are discharging anions becomes greater than the predetermined reference value, direct-current voltages having polarities opposite to those which have been applied thus far are applied to the respective groups of discharge needles. Thus, the degrees of degradation of the respective groups of discharge needles due to corrosion, wear, or the like caused by long-time use are equalized while sufficiently utilizing the advantages of the DC-type ionizer. As a result, it is possible to prevent temporal ionic imbalance and to improve the life of the entire groups of discharge needles.

DESCRIPTION OF EMBODIMENTS

Figure 1:
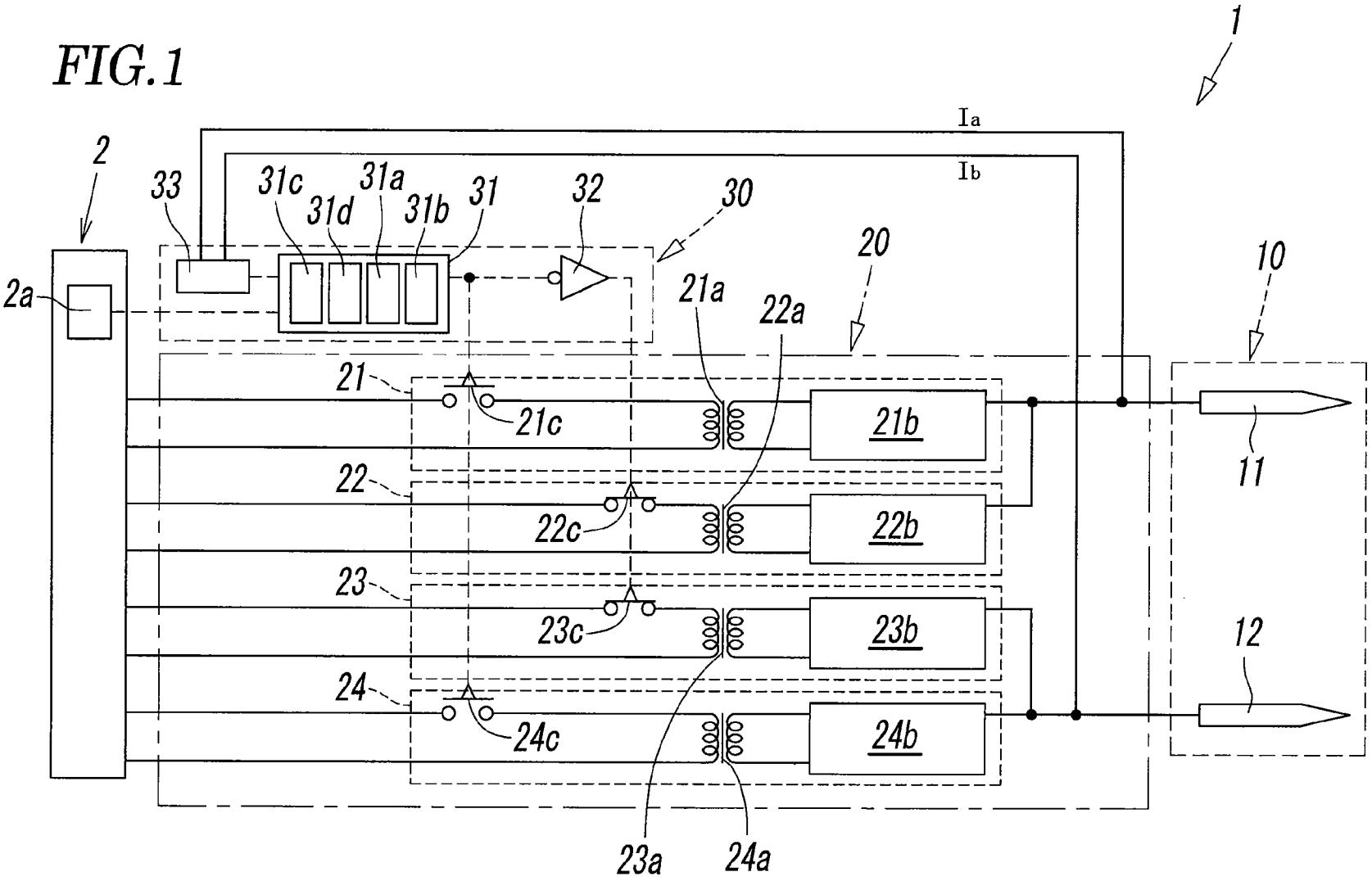
FIG. 1 is a block diagram showing the configuration of an ionizer according to the present invention.

Now, an embodiment of an ionizer according to the present invention will be described in detail. As shown in FIG. 1, an ionizer 1 includes a power supply 2 that outputs a high-frequency voltage, a discharge unit 10 that discharges cations and anions to the target to be subjected to static elimination (not shown), a direct-current voltage output unit (polarity output unit) 20 that applies positive and negative high direct-current voltages to the discharge unit 10, and a polarity control unit 30 that controls the polarities of direct-current high voltages applied to the discharge unit 10 by the direct-current voltage output unit 20.

The power supply 2 is connected to the direct-current voltage output unit 20 and includes a power supply switch 2*a* that can power on or off the direct-current voltage output unit 20 to activate or deactivate the ionizer 1.

The discharge unit 10 includes 2n (n: a natural number) number of discharge needles 11 and 12 that generate cations or anions using a corona discharge which occurs according to the polarity of an applied high direct-current voltage. The 2n number of discharge needles 11 and 12 are grouped into n number of discharge needles 11 forming a first group and n number (that is, the same number as that of the discharge needles forming the first group) of discharge needles 12 forming a second group. High direct-current voltages having opposite polarities are applied to the discharge needles 11 forming the first group and the discharge needles 12 forming the second group, respectively. Thus, cations are discharged from the group of discharge needles to which a positive high direct-current voltage is applied, whereas anions are discharged from the group of discharge needles to which a negative high direct-current voltage is applied.

The direct-current voltage output unit 20 outputs a high direct-current voltage having one polarity and a high direct-current voltage having the opposite polarity to the discharge needles 11 forming the first group and the discharge needles 12 forming the second group, respectively. It includes a first direct-current voltage output circuit 21 that applies a positive high direct-current voltage to the discharge needles 11 forming the first group, a second direct-current voltage output circuit 22 that applies a negative high direct-current voltage to the discharge needles 11 forming the first group, a third direct-current output circuit 23 that applies a positive high direct-current voltage to the discharge needles 12 forming the second group, and a fourth direct-current voltage output circuit 24 that applies a negative high direct-current voltage to the discharge needles 12 forming the second group.

The first direct-current voltage output circuit 21 includes a first step-up transformer 21*a* that boosts a high-frequency voltage outputted from the power supply 2, a first positive circuit 21*b* that converts the high-frequency voltage boosted by the step-up transformer 21*a* into a positive high direct-current voltage and outputs it to the discharge needles 11 forming the first group, and a first switch 21*c* that electrically connects or disconnect the power supply 2 and the positive circuit 21*b*. Similarly, the third direct-current voltage output circuit 23 includes a third step-up transformer 23*a* that boosts a high-frequency voltage outputted from the power supply 2, a second positive circuit 23*b* that converts the high-frequency voltage boosted by the step-up transformer 23*a* into a positive high direct-current voltage and outputs it to the discharge needles 12 forming the second groups, and a third switch 23*c* that electrically connect or disconnect the power supply 2 and the positive circuit 23*b*.

The second direct-current voltage output circuit 22 includes a second step-up transformer 22*a* that boosts a high-frequency voltage outputted from the power supply 2, a first negative circuit 22*b* that converts the high-frequency voltages boosted by the step-up transformers 22*a* into a negative high direct-current voltage and outputs it to the discharge needles 11 forming the first group, and a second switch 22*c* that electrically connects or disconnects the power supply 2 and the negative circuits 22*b*. Similarly, the fourth direct-current voltage output circuit 24 includes a fourth step-up transformer 24*a* that boosts a high-frequency voltage outputted from the power supply 2, a second negative circuit 24*b* that converts the high-frequency voltages boosted by the step-up transformer 24*a* into a negative high direct-current voltage and output it to the discharge needles 12 forming the second group, and a fourth switch 24*c* that electrically connects or disconnects the power supply 2 and the negative circuit 24*b*.

In the ionizer 1, the combinations of on/off states of the first to fourth switches 21*c* to 24*c* are changed according to an command signal from the polarity control unit 30. The direct-current voltage output unit 20 thus configured can selectively output one of the following first and second polarity patterns to the discharge unit 10. In the first polarity pattern, the direct-current voltage output unit 20 applies a positive high direct-current voltage to all the n number of discharge needles 11 forming the first group and applies a negative high direct-current voltage to all the n number of discharge needles 12 forming the second group; and in the second polarity pattern, it applies a negative high direct-current voltage to all the number discharge needles 11 forming the first group and applies a positive high direct-current voltage to all the n number of discharge needles 12 forming the second group. Specifically, when the direct-current voltage output unit 20 outputs the first polarity pattern to the discharge unit 10, the switches 21*c* to 24*c* are controlled by a command signal so that the first and fourth switches 21*c* and 24*c* are turned on and the second and third switches 22*c* and 23*c* are turned off, and when it outputs the second polarity pattern to the discharge unit 10, the switches 21*c* to 24*c* are controlled by a command signal so that the second and third switches 22*c* and 23*c* are turned on and the first and fourth switches 21*c* and 24*c* are turned off.

The polarity control unit 30 includes a command circuit 31 that outputs a signal corresponding to a polarity pattern that it causes the direct-current voltage output unit 20 to output, that is, a polarity-pattern identification signal, a logic inversion circuit 32 that inverts the identification signal outputted from the command circuit 31 and outputs the inverted signal to the second and third switches 22*c* and 23*c* as a command signal, and a current detection unit 33 that detects the value Ia of the current passing through the direct-current voltage output unit 20 to all the discharge needles 11 forming the first group and the value Ib of the current passing through the direct-current voltage output unit 20 to all the discharge needles 12 forming the second group. Note that the command circuit 31 outputs the identification signal to the first and fourth switches 21*c* and 24*c* as a command signal without inverting the signal.

In the corona-discharge ionizer 1 as described above, the discharge needles 11 and 12 of the discharge unit 10 gradually degrade due to corrosion, wear, or the like caused by its long-time use. In particular, the positive discharge needles are known to degrade more easily than the negative discharge needles. Accordingly, for example, if the ionizer 1 applies only a positive high direct-current voltage to the discharge needles 11 forming the first group and applies only a negative high direct-current voltage to the discharge needles 12 forming the second group for a long time, the discharge needles 11 forming the first group would degrade to a greater degree than the discharge needles 12 forming the second group. As a result, the balance between cations and anions discharged from the discharge unit 10 may be lost (that is, ionic balance may be significantly tipped in favor of anions), reducing static elimination performance. Further, the life of the entire discharge needles 11 and 12 forming the respective groups, that is, the life of the discharge unit 10 would decrease.

For this reason, in the ionizer 1 according to the present invention, the command circuit 31 of the polarity control unit 30 includes a flag storage unit 31*a*, a command unit 31*b*, a comparison calculation unit 31*c*, and a flag update unit 31*d*. The flag storage unit 31*a* stores one of flags i assigned to the first and second polarity patterns. The command unit 31*b* outputs an identification signal corresponding to the flag i (that is, the polarity pattern) stored in the flag storage unit 31*a*. The comparison calculation unit 31*c* obtains a current difference ΔI by subtracting the current value of the group of discharge needles to which a positive high direct-current voltage is being applied from the current value of the group of discharge needles to which a negative high direct-current voltage is being applied on the basis of the flag i stored in the flag storage unit 31*a* and the current values Ia and Ib of the first and second groups of discharge needles detected by the current detection unit 33 and compares the obtained current difference ΔI with a predetermined threshold Ik (>0). If the current difference ΔI is greater than the threshold Ik (ΔI>Ik), comparison calculation unit 31*c* outputs a polarity change signal. The flag update unit 31*d* changes the flag i stored in the flag storage unit 31*a* and corresponding to one polarity pattern to a flag i corresponding to the other polarity pattern on the basis of the polarity change signal from the comparison calculation unit 31*c*.

For example, assume that the flag i corresponding to the first polarity pattern is "on (i=1)" and the flag i corresponding to the second polarity pattern is "off (i=0)". If the flag i stored in the flag storage unit 31*a* is "on (i=1)," the command unit 31*b* outputs an identification signal corresponding to the first polarity pattern, and the polarity control unit 30 outputs a command signal for turning on the first and fourth switches 21*c* and 24*c* and turning off the second and third switches 22*c* and 23*c* to the direct-current voltage output unit 20 on the basis of this identification signal. In contrast, if the flag i stored in the flag storage unit 31*a* is "off (i=0)," the command unit 31*b* outputs an identification signal corresponding to the second polarity pattern, and the polarity control unit 30 outputs a command signal for turning on the second and third switches 22*c* and 23*c* and turning off the first and fourth switches 21*c* and 24*c* to the direct-current voltage output unit 20 on the basis of this identification signal.

Each time the group of the discharge needles to which a positive high direct-current voltage has been applied degrades to a greater degree than the other group and thus the current difference ΔI exceeds the threshold Ik, the flag update unit 31*d* changes the flag i stored in the flag storage unit 31*a*. Thus, a negative high direct-current voltage is applied to the group of discharge needles to which a positive high direct-current voltage has been applied, and a positive high direct-current voltage is applied to the other group of discharge needles. As a result, it is possible to equalize the degrees of degradation of the discharge needles 11 forming the first group and the discharge needles 12 forming the second group to prevent temporal ionic imbalance while sufficiently utilizing the advantages of the DC type (direct-current type) that recombination of cations and anions is suppressed and that more cations and anions can be discharged away. It is also possible to improve the entire life of the discharge needles 11 and 12 forming the respective groups, that is, the life of the discharge unit 10.

Next, a first embodiment of the method for controlling the ionizer 1 will be described specifically with reference to the flowchart of FIG. 2.

First, the power supply 2 is turned on by operating the power supply switch 2*a* (S1). Based on a power-on signal from the power supply switch 2*a*, the flag update unit 31*d* resets the flag i stored in the flag storage unit 31*a* to "off (i=0)" (S2).

Based on the flag i stored in the flag storage unit 31*a*, the command unit 31*b* outputs an "off" identification signal corresponding to the flag i=0, that is, the second polarity pattern (S3). Based on this identification signal, the polarity control unit 30 outputs a command signal. Based on this command signal, the direct-current voltage output unit 20 turns off the first and fourth switches 21*c* and 24*c* and turns on the second and third switches 22*c* and 23*c* (S4). Thus, the first negative circuit 22*b* applies a negative high direct-current voltage to the discharge needles 11 forming the first group, and the second positive circuit 23*b* applies a positive high direct-current voltage to the discharge needles 12 forming the second group (S5). As a result, the discharge needles 11 forming the first group and the discharge needles 12 forming the second group discharge anions and cations, respectively.

In step S6, the comparison calculation unit 31*c* determines whether the current difference ΔI (Ia-Ib) obtained by subtracting the current value Ib of the positive discharge needles 12 forming the second group from the current value Ia of the negative discharge needles 11 forming the first group is equal to or smaller than the threshold Ik.

If the current difference ΔI is equal to or smaller than the threshold Ik, the comparison calculation unit 31*c* determines that the degree of degradation of the positive discharge needles 12 relative to the negative discharge needles 11, that is, the balance between cations and anions discharged from the discharge unit 10 falls within the allowable range. The process then proceeds to step S7, and the polarity control unit 30 checks whether the power supply 2 is on or off. If the power supply 2 remains on, the flag i in the flag storage unit 31*a* remains "off (i=0)". Accordingly, the direct-current voltage output unit 20 continues applying the high direct-current voltages of the second polarity pattern to the discharge needles 11 and 12 forming the first and second groups (S3 to S5). If the power supply 2 is off in step S7, the power supply from the power supply 2 to the direct-current voltage output unit 20 is shut off. Thus, the discharge needles 11 and 12 forming the first and second groups end the discharge of ions.

In contrast, if the current difference ΔI is greater than the threshold Ik in step S6, the comparison calculation unit 31*c* determines that the degree of degradation of the positive discharge needles 12 relative to the negative discharge needles 11 has exceeded the allowable range. Based on a polarity change signal from the comparison calculation unit 31*c*, the flag update unit 31*d* changes the flag i stored in the flag storage unit 31*a* from "off (i=0)", which corresponds to the second polarity pattern, to "on (i=1)", which corresponds to the first polarity pattern (S8).

Based on the updated flag i in the flag storage unit 31*a*, the command unit 31*b* outputs an "on" identification signal corresponding to the flag i=1, that is, the first polarity pattern (S9). Based on this identification signal, the polarity control unit 30 outputs a command signal. Based on this command signal, the direct-current voltage output unit 20 turns on the first and fourth switches 21*c* and 24*c* and turns on the second and third switches 22*c* and 23*c* (S10). Thus, the first positive circuit 21*b* applies a positive high direct-current voltage to the discharge needles 11 forming the first group, and the second negative circuit 24*b* applies a negative high direct-current voltage to the discharge needles 12 forming the second group (S11). As a result, the discharge needles 11 forming the first group and the discharge needles 12 forming the second group discharge cations and anions, respectively.

In step S12, the comparison calculation unit 31*c* determines whether the current difference ΔI (Ib-Ia) obtained by subtracting the current value Ia of the positive discharge needles 11 forming the first group from the current value Ib of the negative discharge needles 12 forming the second group is equal to or smaller than the threshold Ik.

If the current difference ΔI is equal to or smaller than the threshold Ik, the comparison calculation unit 31*c* determines that the degree of degradation of the positive discharge needles 11 relative to the negative discharge needles 12 falls within the allowable range. The process then proceeds to step S13, and the polarity control unit 30 checks whether the power supply 2 is on or off. If the power supply 2 remains on, the flag i in the flag storage unit 31*a* remains "on (i=1)". Accordingly, the direct-current voltage output unit 20 continues applying the high direct-current voltages of the first polarity pattern to the discharge needles 11 and 12 forming the first and second groups (S9 to S11). If the power supply 2 is off in step S13, the ionizer 1 is deactivated. Thus, the discharge needles 11 and 12 forming the first and second groups end the discharge of ions.

In contrast, if the current difference ΔI is greater than the threshold Ik in step S12, the comparison calculation unit 31*c* determines that the degree of degradation of the positive discharge needles 11 relative to the negative discharge needles 12 has exceeded the allowable range. Then, based on a polarity change signal from the comparison calculation unit 31*c*, the flag update unit 31*d* again changes the flag i stored in the flag storage unit 31*a* from "on (i=1)", which corresponds to the first polarity pattern, to "off (i=0)", which corresponds to the second polarity pattern (S2). Hereafter, similar operations to the above steps are repeated.

Figure 2:
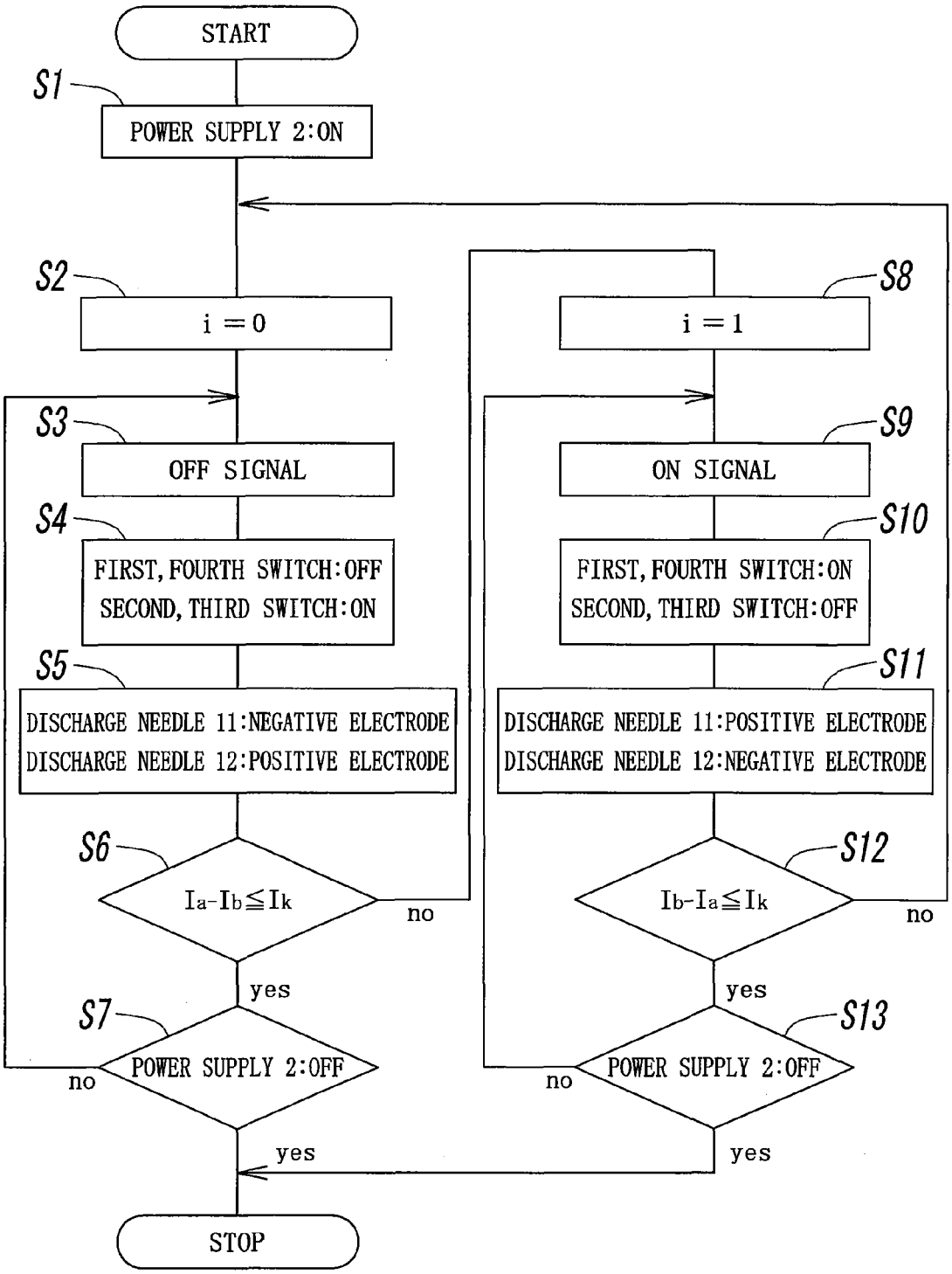
FIG. 2 is a flowchart showing a method for controlling the ionizer according to the present invention.
Figure 3:
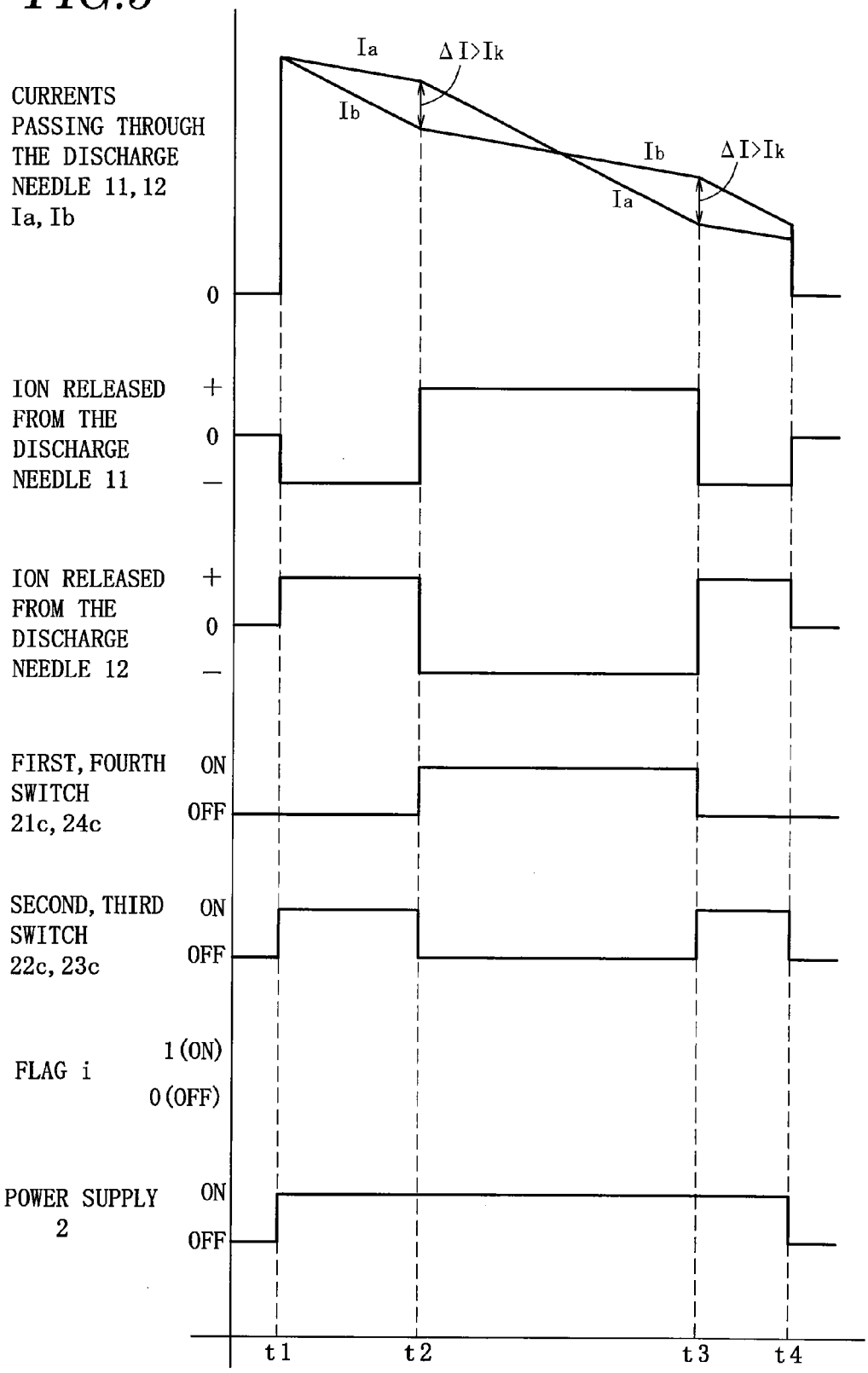
FIG. 3 is a timing chart when controlling the ionizer according to the present invention.

FIG. 3 shows a timing chart when the ionizer 1 is controlled in the first embodiment shown in FIG. 2.

First, at time t1, the power supply 2 is turned on and thus the flag i stored in the flag storage unit 31*a* is reset to "off (i=0)". Based on the reset flag i (=0) in the flag storage unit 31*a*, the polarity control unit 30 outputs a command signal. Based on this command signal, the first and fourth switches 21*c* and 24*c* are turned off, and the second and third switches 22*c* and 23*c* are turned on. Thus, high direct-current voltages of the second polarity pattern are applied to the discharge unit 10. As a result, the discharge needles 11 forming the first group and the discharge needles 12 forming the second group discharge anions and cations, respectively.

If the high direct-current voltages of the second polarity pattern are continuously applied to the discharge unit 10 in this manner, the positive discharge needles 12 forming the second group degrade to a greater degree than the negative discharge needles 11 forming the first group. Thus, the value Ib of the current passing through the second group decreases compared to the value Ia of the current passing through the first group. When the current difference ΔI (Ia-Ib) becomes greater than the predetermined threshold Ik (t2), the flag update unit 31*d* changes the flag i from "off (i=0)", which is assigned to the second polarity pattern, to "on (i=1)", which is assigned to the first polarity pattern.

Thus, the first and fourth switches 21*c* and 24*c* are turned on and the second and third switches 22*c* and 23*c* are turned off, so that high direct-current voltages of the first polarity pattern are applied to the discharge unit 10. As a result, the discharge needles 11 forming the first group and the discharge needles 12 forming the second group discharge cations and anions, respectively.

This time, the positive discharge needles 11 forming the first group degrade to a greater degree than the discharge needles 12 forming the second group. Thus, the difference in degradation degree between the discharge needles 11 and 12 forming the respective groups gradually decreases for a while. However, as the time passes, the discharge needles 11 forming the first group degrade to a greater degree. Thus, the current difference ΔI (Ib-Ia) gradually increases again. When the current difference AI again becomes greater than the predetermined threshold Ik (t3), the flag update unit 31*d* again changes the flag i from "on (i=1)" to "off (i=0)". Thus, high direct-current voltages of the second polarity pattern are applied to the discharge unit 10. As a result, the discharge needles 11 forming the first group and the discharge needles 12 forming the second group discharge anions and cations, respectively. Subsequently, each time the current difference AI becomes greater than the threshold Ik, similar operations are repeated. Thus, the difference in degradation degree between the discharge needles 11 and 12 forming the respective groups is maintained within the predetermined range.

At time t4, the power supply 2 is turned off and thus the discharge needles 11 and 12 forming the respective groups stop discharging ions. At this time, the flag stored in the flag storage unit 31*a* is kept at "off (i=0)", whereas the second and third switches 22*c* and 23*c* are turned off.

While the embodiment of the present invention has been described in detail above, the present invention is not limited thereto. Various changes can be made to the embodiment without departing from the spirit and scope of the invention.

For example, while, in the above embodiment, the direct-current voltage output unit 20 outputs the second polarity pattern to the discharge unit 10 when the polarity pattern identification is "off" and outputs the first polarity pattern thereto when the signal is "on", it may output the second polarity pattern to the discharge unit 10 when the polarity pattern identification signal is "on" and outputs the first polarity pattern thereto when the signal is "off".

Also, while the sum value of the respective currents passing through the discharge needles 11 and the sum value of the respective currents passing through the discharge needles 12 are defined as Ia and Ib, respectively, the average value of the currents passing through the discharge needles 11 and the average value of the currents passing through the discharge needles 12 may be defined as Ia and Ib, respectively.

Also, the flag i in the flag storage unit 31*a* may be reset to "i=1" in step S2 of FIG. 2 and then changed to "i=0" in step S8.

REFERENCE SIGNS LIST

2 power supply
2*a* power supply switch
10 discharge unit
11 first group of discharge needles
12 second group of discharge needles
20 direct-current voltage output unit (polarity output unit)
21*b* first positive circuit
21*c* first switch
22*b* first negative circuit
22*c* second switch
23*b* second positive circuit
23*c* third switch
24*b* second negative circuit
24*c* fourth switch
30 polarity control unit
31 command circuit
31*a* flag storage unit
31*b* command unit
31*c* comparison calculation unit
31*d* flag update unit
33 current detection unit

The invention claimed is:

1. An ionizer comprising:

a discharge unit comprising 2n number of discharge needles configured to discharge cations or anions in accordance with the polarity of an applied direct-current voltage, n being a natural number, wherein the discharge needles are grouped into a first group of n number of discharge needles and a second group of n number of discharge needles;

a polarity output unit that can selectively output, to the discharge unit, one of a first polarity pattern where the polarity output unit applies a positive direct-current voltage to the first group of discharge needles and applies a negative direct-current voltage to the second group of discharge needles and a second polarity pattern where the polarity output unit applies a negative direct-current voltage to the first group of discharge needles and applies a positive direct-current voltage to the second group of discharge needles;

a polarity control unit configured to control a polarity pattern outputted by the polarity output unit; and a power supply connected to the polarity output unit and configured to supply power to the polarity output unit, wherein the polarity control unit comprises a current detection unit configured to detect values of respective currents passing through the first group of discharge needles and the second group of discharge needles and wherein when a value obtained by subtracting, from a current value of one group to which a negative direct-current voltage has been applied, a current value of the other group to which a positive direct-current voltage has been applied becomes greater than a predetermined value, the polarity control unit outputs, to the polarity output unit, a command signal for changing the polarity pattern outputted by the polarity output unit from one polarity pattern which has been outputted thus far to the other polarity pattern.

2. The ionizer according to claim 1, wherein the polarity output unit comprises:

a first positive circuit configured to apply a positive direct-current voltage to the first group of discharge needles;

a first negative circuit configured to apply a negative direct-current voltage to the first group of discharge needles;

a second positive circuit configured to apply a positive direct-current voltage to the second group of discharge needles;

a second negative circuit configured to apply a negative direct-current voltage to the second group of discharge needles;

a first switch configured to electrically connect or disconnect the power supply and the first positive circuit;

a second switch configured to electrically connect or disconnect the power supply and the first negative circuit;

a third switch configured to electrically connect or disconnect the power supply and the second positive circuit; and a fourth switch configured to electrically connect or disconnect the power supply and the second negative circuit, wherein the polarity output unit outputs the first polarity pattern by turning on the first switch and the fourth switch and turning off the second switch and the third switch on the basis of a command signal from the polarity control unit or outputs the second polarity pattern by turning off the first switch and the fourth switch and turning on the second switch and the third switch on the basis of a command signal from the polarity control unit.

3. A method for controlling an ionizer, the ionizer comprising a discharge unit comprising 2n number of discharge needles configured to discharge cations or anions in accordance with the polarity of an applied direct-current voltage, n being a natural number, wherein the discharge needles are grouped into a first group of n number of discharge needles and a second group of n number of discharge needles; a polarity output unit that can selectively output, to the discharge unit, one of a first polarity pattern where the polarity output unit applies a positive direct-current voltage to the first group of discharge needles and applies a negative direct-current voltage to the second group of discharge needles and a second polarity pattern where the polarity output unit applies a negative direct-current voltage to the first group of discharge needles and applies a positive direct-current voltage to the second group of direct-current voltage; and a power supply connected to the polarity output unit and configured to supply power to the polarity output unit, the method comprising:

detecting values of respective currents passing through the first group of discharge needles and the second group of discharge needles; and when a value obtained by subtracting, from a current value of one group to which a negative direct-current voltage has been applied, a current value of the other group to which a positive direct-current voltage has been applied becomes greater than a predetermined value, changing a polarity pattern outputted by the polarity output unit from one polarity pattern which has been outputted thus far to the other polarity pattern.

* * * * *